US006021933A

United States Patent [19]

Zuckerman

[11] Patent Number: 6,021,933

[45] Date of Patent: Feb. 8, 2000

[54] SECURE PINCH-GRIP HANGER

[75] Inventor: Andrew M. Zuckerman, Forest Hills, N.Y.

[73] Assignee: Carlisle Plastics Inc., North Bergen, N.J.

[21] Appl. No.: 09/085,900

[22] Filed: May 27, 1998

Related U.S. Application Data

[63] Continuation-in-part of application No. 09/024,213, Feb. 13, 1998, abandoned.

[51] Int. Cl.[7] ..... A47G 25/48

[52] U.S. Cl. ..... 223/96; 223/95

[58] Field of Search ..... 223/96, 93, 91, 223/90, 95, 85

[56] References Cited

U.S. PATENT DOCUMENTS

| | | |
|---|---|---|
| 549,145 | 11/1895 | Mickelson . |
| 670,027 | 3/1901 | Malmberg . |
| 2,524,537 | 10/1950 | Osmonson . |
| 3,235,928 | 2/1966 | Clark . |
| 3,292,223 | 12/1966 | Esposita, Jr. . |
| 3,767,092 | 10/1973 | Garrison et al. . |
| 3,946,915 | 3/1976 | Crane . |
| 3,950,829 | 4/1976 | Cohen . |
| 3,973,705 | 8/1976 | Erthein . |
| 4,335,838 | 6/1982 | Bisk et al. . |
| 4,706,347 | 11/1987 | Lindsay . |
| 4,763,390 | 8/1988 | Rooz . |
| 5,082,153 | 1/1992 | Duester et al. . |
| 5,178,306 | 1/1993 | Petrou . |
| 5,297,706 | 3/1994 | Blitz . |
| 5,361,948 | 11/1994 | Batts . |
| 5,400,932 | 3/1995 | Hollis ..... 223/96 |

FOREIGN PATENT DOCUMENTS

| | | |
|---|---|---|
| B15254/92 | 11/1992 | Australia . |

*Primary Examiner*—Bibhu Mohanty
*Attorney, Agent, or Firm*—Amster, Rothstein & Ebenstein

[57] ABSTRACT

A pinch-grip hanger includes an attachment portion for securing the hanger to a support and at least one pinch-grip for receiving an article for hanging. The pinch-grip includes a pair of components secured to each other, each component including an end for receiving the article therebetween. The pinch-grip also includes a biasing element for biasing the ends together and for permitting separation of the ends towards a fully extended open position by movement of at least one the components. One of the components includes at least one projection extending towards the other component to inhibit some accidental movement of the pinch-grip towards the fully extended open position while permitting intentional movement of the pinch-grip towards the fully extended open position.

31 Claims, 11 Drawing Sheets

FIG. 2A
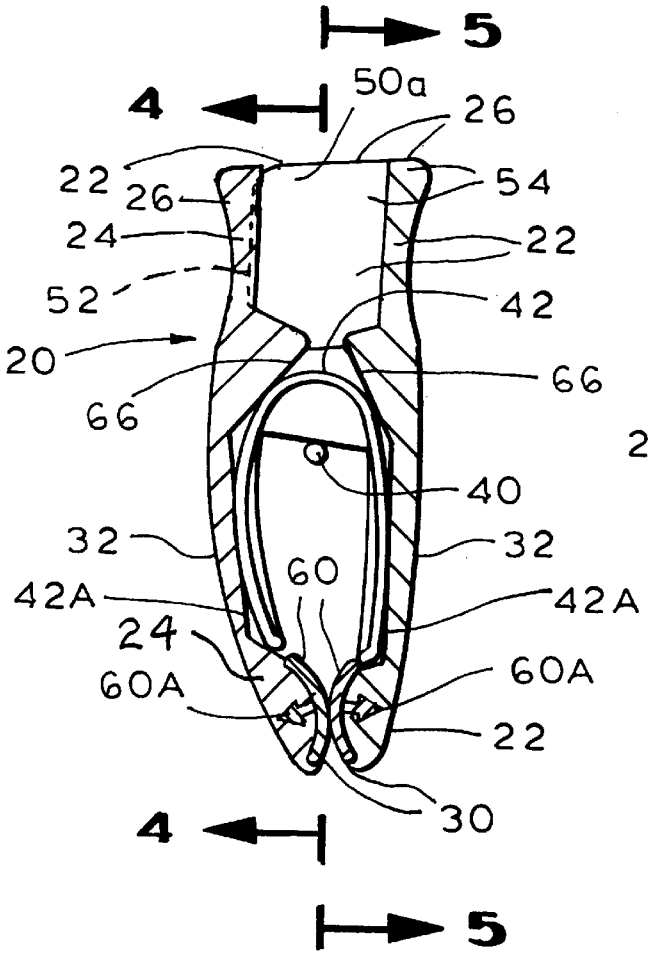
FIG. 2D
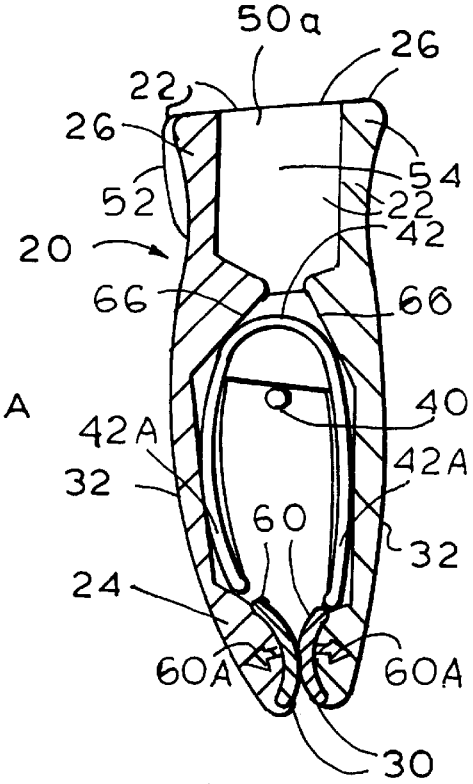
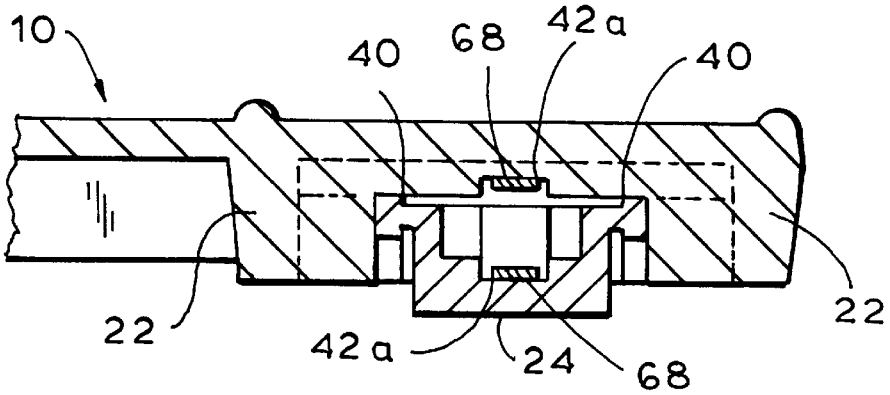
FIG. 3

FIG. 14
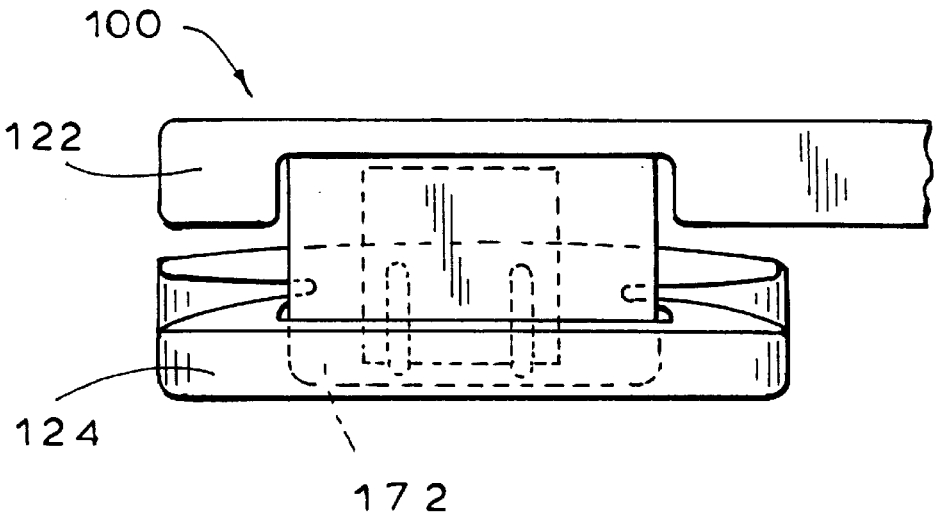
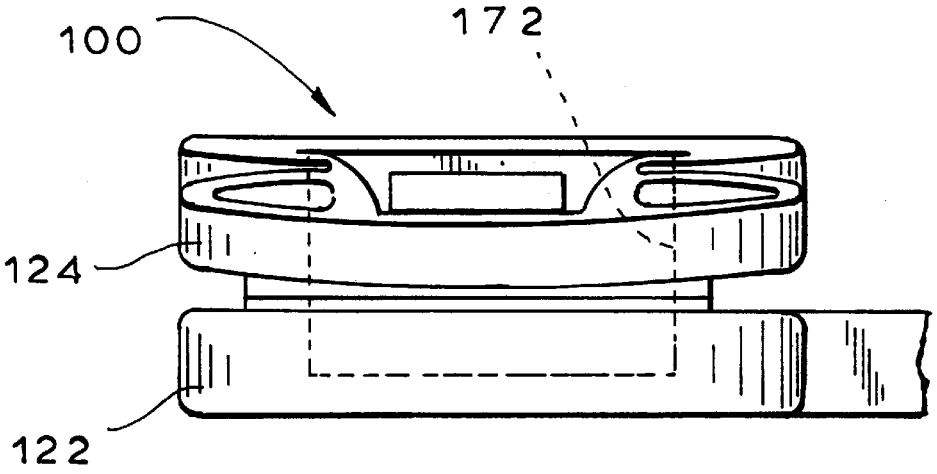
FIG. 15

SECURE PINCH-GRIP HANGER

CROSS-REFERENCE TO RELATED APPLICATION

This is a continuation-in-part of application No. 09/024,213, now abandoned filed Feb. 13, 1998.

BACKGROUND OF THE INVENTION

The present invention relates to a pinch-grip hanger, and more particularly to a pinch-grip hanger adapted for use in transporting articles such as garments.

Pinch-grip hangers are well known. A hanger body includes an attachment portion for securing the hanger body to a support (for example, a hook for securing the hanger body to a transversely-extending elevated rod). A pinch-grip is attached to the hanger body. Optionally, the hanger body also includes a transverse portion defining a pair of free ends (for example, a pair of outwardly extending wings for supporting the shoulders of a jacket), and optionally one pinch-grip is disposed adjacent to each of the transverse portion free ends. Each pinch-grip includes a pair of vertically-extending components, means for pivotally securing the components together, and means for biasing the bottom ends of the components together. Typically each component has an upper end, a lower end and a central or connecting component portion between the ends. The bottom ends are configured and dimensioned to cooperatively receive and maintain an article therebetween under the influence of the biasing means. Preferably the securing means pivotably secures one connecting component portion to another connecting component portion. To insert or remove an article from the hanger, the upper ends of the components are pressed together so that the components pivot relatively and the lower ends thereof separate. In this "open" or releasing orientation, the article may be removed from or secured to the hanger. Finally, when the upper ends of the components are released, the biasing means causes the components to pivot relatively and return more-or-less to their original orientation with the upper ends spaced apart and the lower ends biased together. In this "closed" or gripping orientation, an article may be suspended by and between the component bottom ends. If no article is between them, the component bottom ends may actually touch and abut, thereby to form an "abutting" orientation.

Such pinch-grip hangers are frequently used at retail stores to display garments suspended from the pinch-grips, such as a pair of pants, a skirt, or the like. In the optimal retail setting, the garment hangers (and the garments thereon) are sufficiently spaced from one another along a rod or other elevated horizontally extending support so that the pinch-grip components are not likely to undergo a re-orientation relative to one another as a result of pressure exerted thereon by an adjacent hanger or the clothing thereon. However, in fact, the garment hangers (and the garments thereon) are usually tightly pressed, one against the next, so as to put on display to potential customers the maximum number of garments. In this situation, the pinch-grips may open as result of the pressure exerted thereon by an adjacent hanger or by the clothing thereon. As a result, the clothing supported by the pinch-grip will fall to the floor.

Even where the hangers (and the garments thereon) are not crowded together along a rod or like support when being displayed, they are typically crowded together during handling.

In particular, pinch-grip hangers are not well suited for use in the transport (shipping) of garments suspended from or attached to the pinchgrips. During such transport, for economic reasons, typically as many hangers (and the garments thereon) as possible will be forcibly pushed together (i.e., crowded)on a rod or like support (such as the loops of a looped rope, known as "a banana rope") or in a box. Even if the close pressing together of the hangers (either on a rod or loop or in a box) is by itself insufficient to cause the opening of a pinch-grip, the added forces conveyed to the pinch-grip during transport may be sufficient to open the same. Thus, when garments are transported by various vehicles, abrupt starts-and-stops, turning or the like may result in a pinch-grip hanger losing the garment. Clearly this is highly undesirable as the garment falling completely or partially onto a floor may become ruined or may at least require pressing before it is ready to be displayed for sale. More importantly, labor costs are incurred in picking up the fallen garments during transport and reinserting them in the pinch-grip hanger. As a result of these problems, pinch-grip hangers are typically not used during transport, even though they are preferred by the retail stores.

Accordingly, it is an object of the present invention to provide a secure pinch-grip hanger suitable for suspending garments during transport, handling and display.

Another object is to provide such a hanger which is simple to manufacture, use and maintain and is comparable in cost to a conventional hanger of the same type.

SUMMARY OF THE INVENTION

It has now been found that the above and related objects of the present invention are obtained in a secure pinch-grip hanger. The secure pinch-grip hanger suitable for the transport of garments includes an attachment portion for securing the hanger to a support and at least one pinch-grip. Each pinch-grip includes a pair of components secured to each other and each component includes a lower end for receiving an article for hanging therebetween. The pinch-grip also includes means for biasing the lower ends together and for permitting separation of said lower ends to a fully extended open position. Generically, one of the pair of components includes at least one projection extending towards the other of the pair of components to inhibit some accidental relative movement of the other of the pair of components towards the fully extended open position while still enabling intentional relative movement of the other of the pair of components towards the fully extended open position.

The projection may be on an upper end of one of the pair of components and may or may not extend beyond the upper end of the other of the pair of components when the pair of lower ends of the components are abutting without any garment therebetween. Alternatively, one of the pair of upper ends defines an aperture for passage of the projection therethrough or the projection extends at least partially about a periphery of the other of the pair of upper ends. Preferably a stationary one of the pair of upper ends includes the projection.

In a first embodiment, one of the pair of upper ends includes at least one projection defining a recess facing the other upper end, and the other upper end is configured and dimensioned to define a head which can be received in the recess such that the recess extends towards the head to protect the head against accidental relative movement thereof towards (in the direction of) the fully extended open position while still enabling intentional relative movement of the head towards (in the direction of) the fully extended open position.

Preferably, the recess is defined by at least one projection which is typically disposed on at least one side of the head.

Alternatively, the projection is disposed only on both sides of the head or only above the head. Optimally, the projection is disposed on both sides of the head and above the head.

In a second embodiment, one of the pair of upper ends includes a projection extending through the other of the pair of upper ends, and the other of the pair of upper ends defines an aperture for passage of the projection therethrough such that the projection extends towards the other of the pair of upper ends to protect the other upper end against accidental relative movement thereof towards (in the direction of) the fully extended open position while still enabling intentional relative movement of the other of the pair of upper ends towards (in the direction of) the fully extended open position.

Preferably the projection has a top wall, a bottom wall and a pair of sidewalls connecting the top and bottom walls, the projection being smaller in cross section than the aperture, which extends fully about the projection at all times.

Typically, the one upper end is stationary and the other upper end is pivotable relative to the stationary upper end.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIGS. 2A, 2B and 2C are sectional views thereof in the abutting, gripping and releasing orientations, respectively, taken along the line 2—2 of FIG. 1;

FIG. 2D is a view similar to FIG. 2A, but showing an alternative abutting orientation;

FIG. 3 is a fragmentary sectional view thereof, taken along the line 3—3 of FIG. 1;

FIG. 14 is a fragmentary top plan view of the pinch grip; and

FIG. 15 is a bottom plan view of the pinch grip.

DETAILED DESCRIPTION OF THE PREFERRED EMBODIMENTS

Figure 1:
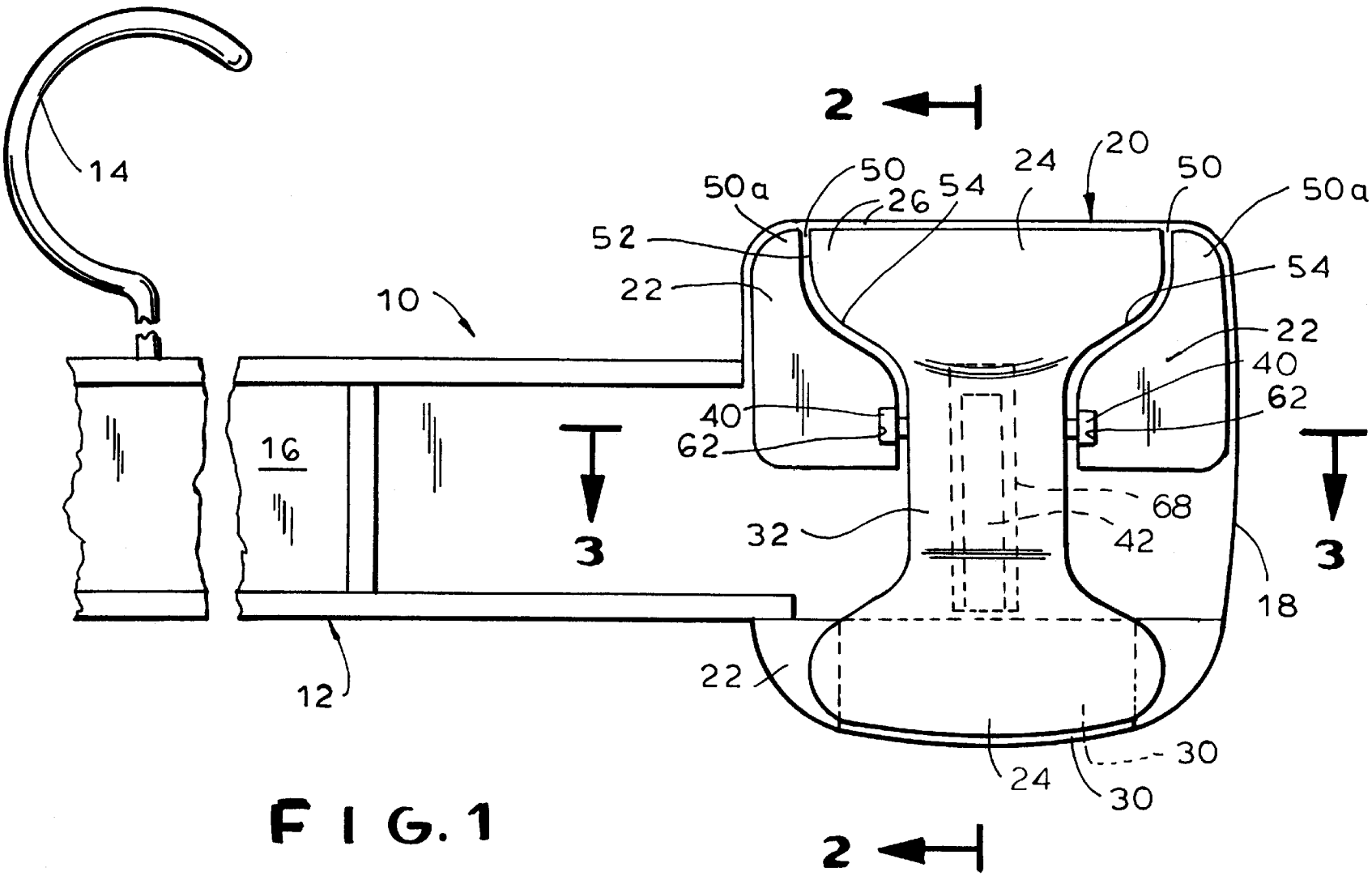
FIG. 1 is a fragmentary front elevational view of a first embodiment of a secure pinch-grip hanger according to the present invention.

Referring now to the drawing, and in particular to FIG. 1 thereof, therein illustrated is a secure pinch-grip hanger according to the present invention, generally designated by the reference numeral 10. In its conventional aspects, the hanger 10 comprises a hanger body 12 including an attachment portion 14 for securing the body 12 to a support (not shown) and optionally, as illustrated, a transverse portion 16 defining a pair of free outer ends 18. Although the attachment portion 14 is illustrated as a hook, clearly other means for attaching the hanger body 12 to a support (such as a transversely-extending elevated rod—not shown) may be utilized. The hanger body 12 (including both the attachment portion 14 and the optional transverse portion 16) is conveniently formed of injection molded plastic.

The hanger 10 additionally includes at least one pinch-grip, generally designated 20. Each pinch-grip 20 includes a pair of substantially rigid, vertically-extending components 22, 24. Each of the vertically-extending components 22, 24 defines an upper end 26, a lower end 30, and a connecting component portion 32 between the ends 26, 30. Preferably, one pinch-grip 20 is disposed adjacent each free end 18 of the transverse portion 16 (as illustrated), although alternatively the hanger 10 may include a single pinch-grip 20 disposed centrally (i.e., intermediate the free ends 18).

Figure 2B:
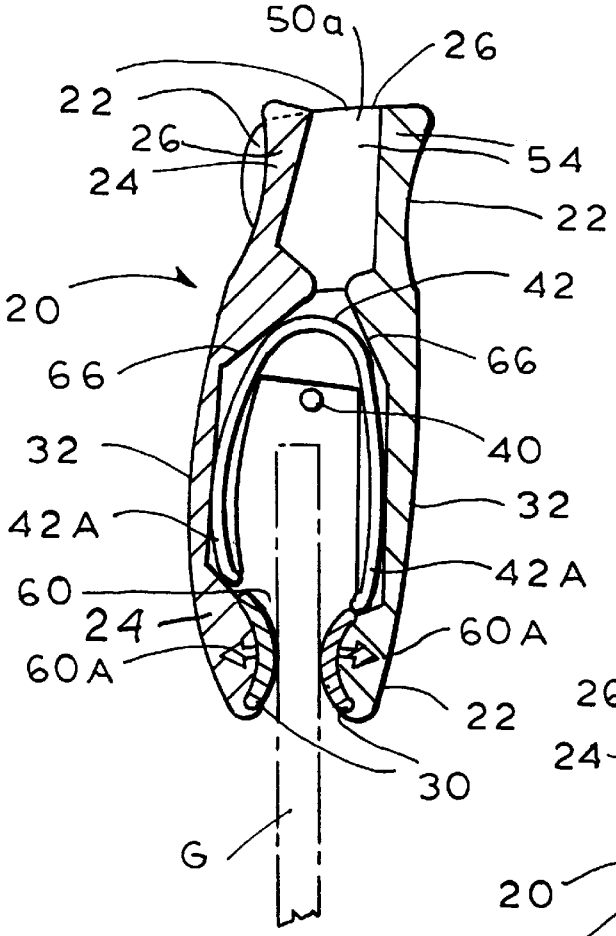
Figure 2C:
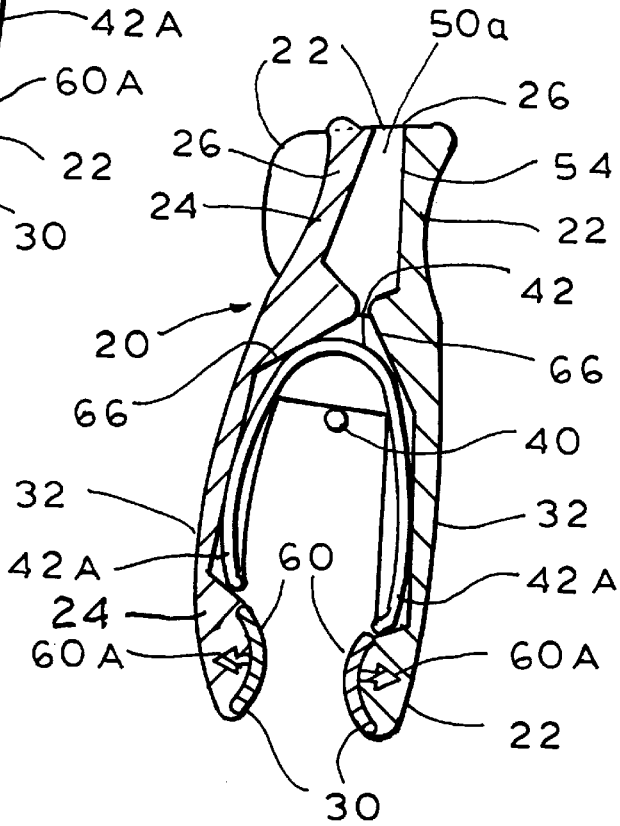
Figure 5:
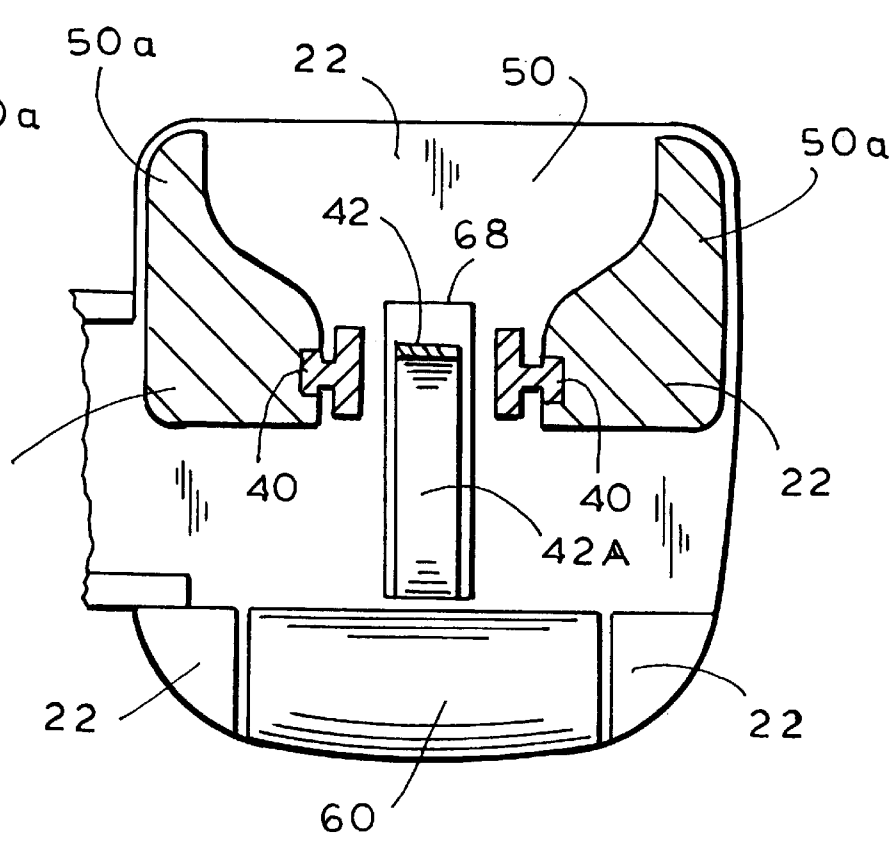
FIGS. 4 and 5 are fragmentary sectional views thereof, taken along the lines 4—4 and 5—5, respectively, of FIG. 2.
Figure 4:
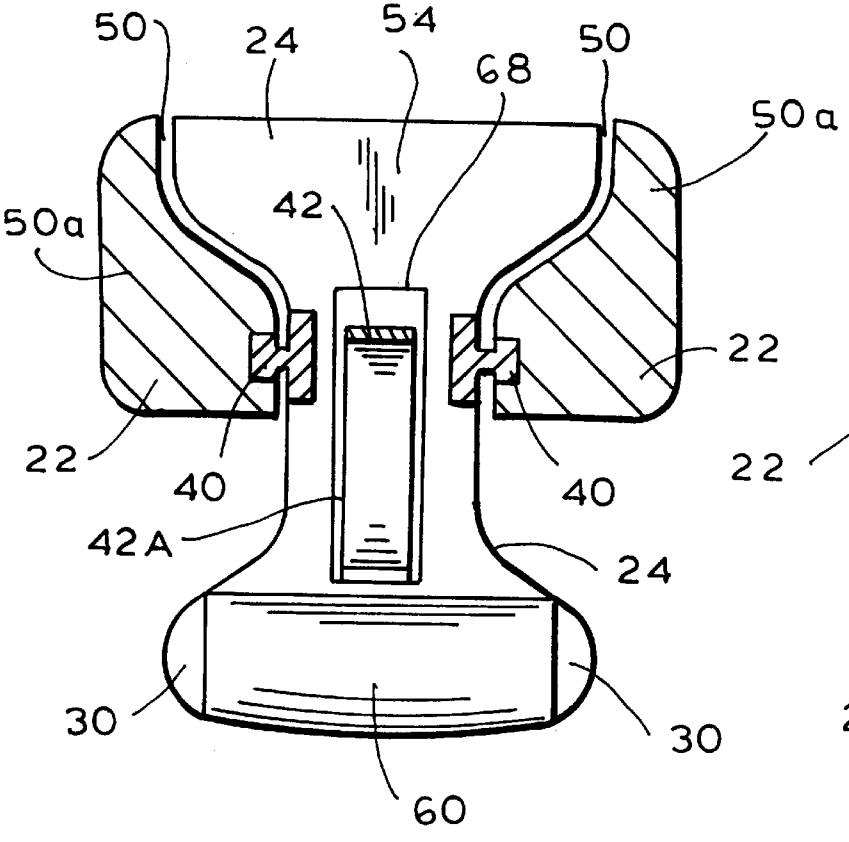

Means 40 are provided for pivotably securing the components 22, 24 together such that, when the upper ends 26 of the components 22, 24 are brought together as close as possible, the lower ends 30 are separated from each other as far as possible (the "fully extended open position"). In use, when the upper ends 26 are moved toward the fully extended open position, as illustrated in FIG. 2C, the lower ends 30 thereof separate to enable insertion or removal of an article or garment therebetween ("the releasing orientation"). Preferably securing means 40 pivotably secures one connecting component portion 32 of one component 22, 24 to the connecting component portion 32 of the other component 24, 22. The pivotable securing means 40 may be a living hinge (not shown) when the vertically-extending components 22, 24 are formed of plastic, although a variety of different securing mechanisms may be used instead. Preferably one component 24 is pivotable, and the other component 22 is stationary relative to the hanger body.

Means 42 are provided for biasing the bottom ends 30 of the two components 22, 24 together to define the "closed" or gripping orientation wherein the upper ends 26 of the two components 22, 24 are spaced apart. In this orientation, the bottom ends 30 are configured and dimensioned to cooperatively receive and maintain an article, such as a garment G (shown in phantom line), therebetween, as illustrated in FIG. 2B, thereby to suspend the garment on a rod or like support.

In the absence of any garment between the bottom ends 30 of the two components 22, 24, biasing means 42 biases such bottom ends 30 together to define the "abutting" orientation wherein the bottom ends 30 touch, as illustrated in FIG. 2A and 2D.

The biasing means 42 may be separate and distinct from the securing means 40, or the two means 40, 42 may be combined into a single element, such as a strongly resilient living hinge (not shown).

Figure 6:
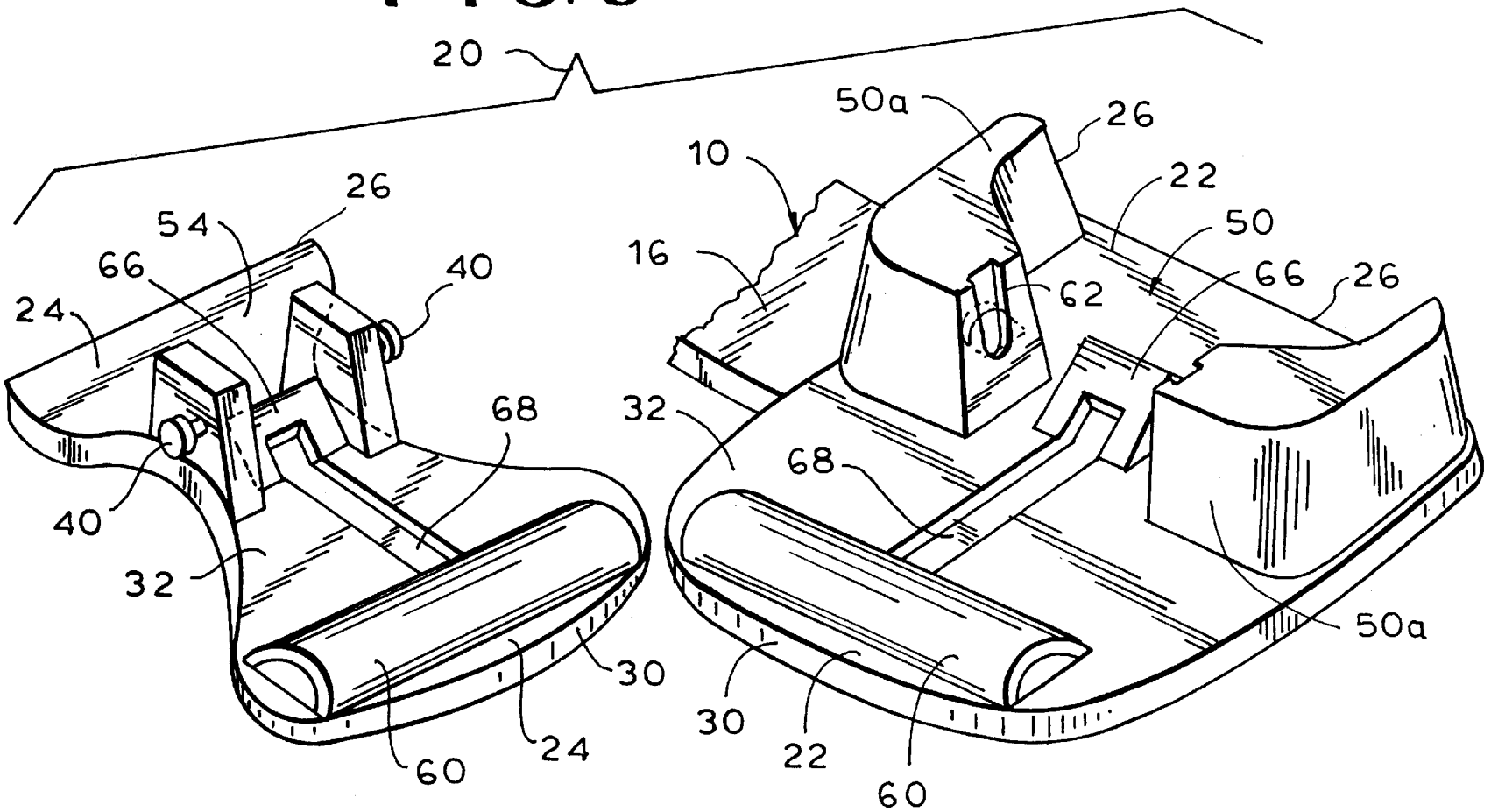
FIG. 6 is an exploded isometric view of the pinch-grip components.

The pinch-grip components 22, 24 are conveniently formed of plastic with each component 22, 24 typically being separately injection molded, as illustrated in FIG. 6, or the two components 22, 24 injection molded along with a connecting living hinge (not shown).

The present invention provides that the upper end 26 of one component 22 is configured and dimensioned to define a raised pocket, collar or recess 50 facing the upper end 26 of the other component 24 and having recess side surfaces 52. The upper end 26 of the other component 24 is configured and dimensioned to define a head 54 which, in the closed orientation, is totally or partially received in the pocket, collar or recess 50 such that the recess 50 projects further forwardly (to the left in FIGS. 2B and 2C) than the head 54 to provide some protection to the head from forces being accidentally imposed thereon.

Figure 7:
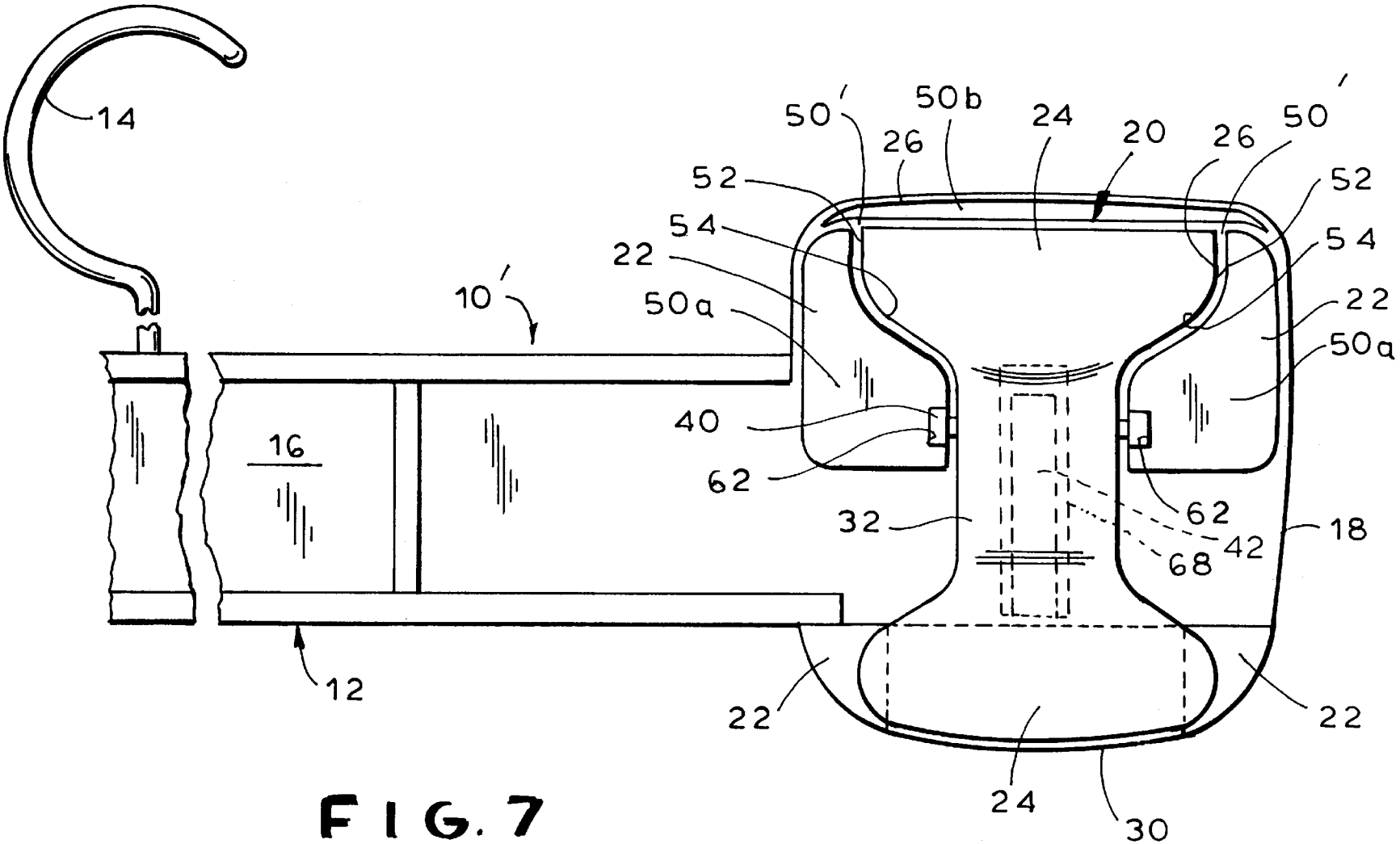
FIGS. 7 and 8 are views similar to FIG. 1 of the second and third embodiments, respectively.
Figure 8:
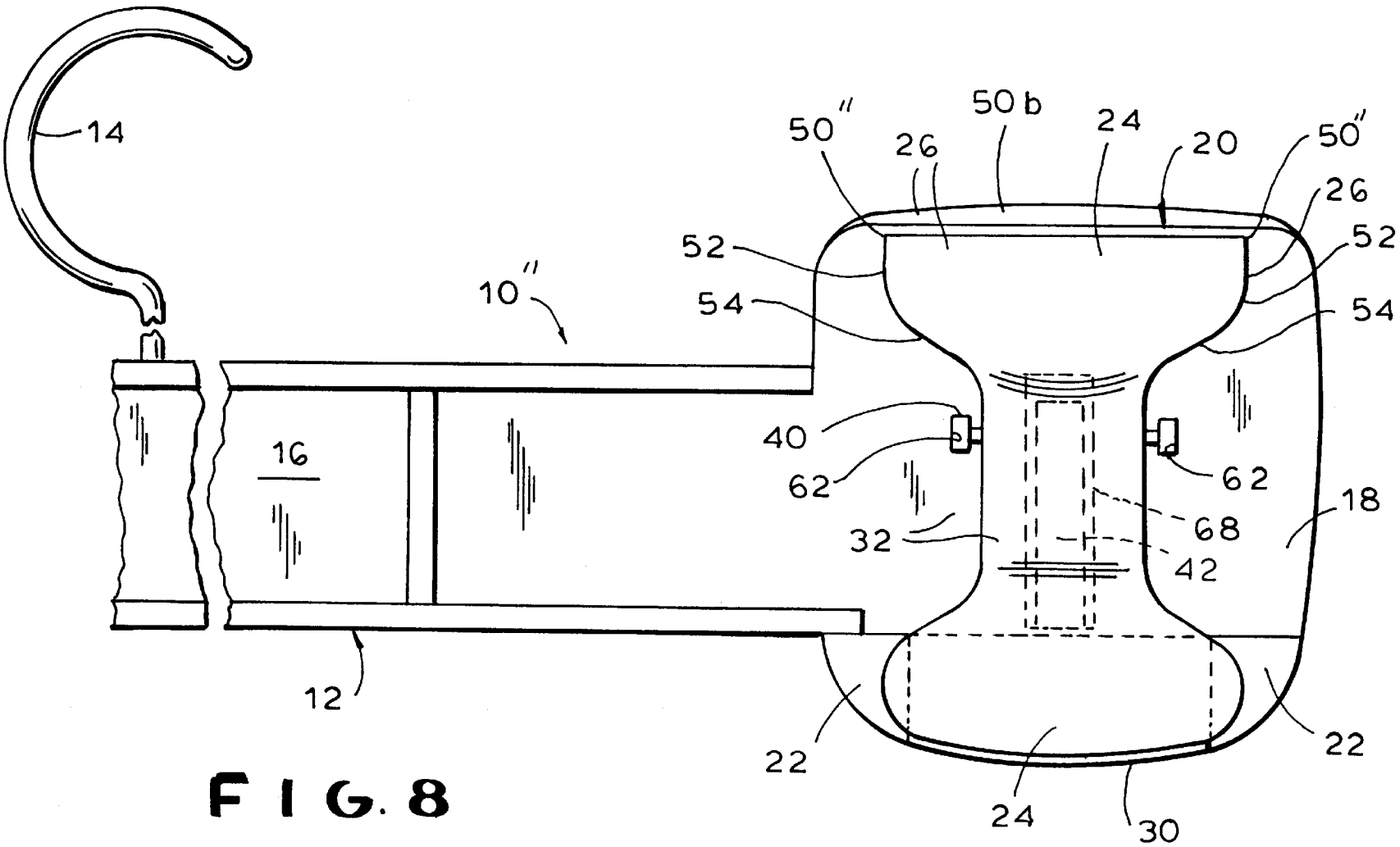
Figure 9:
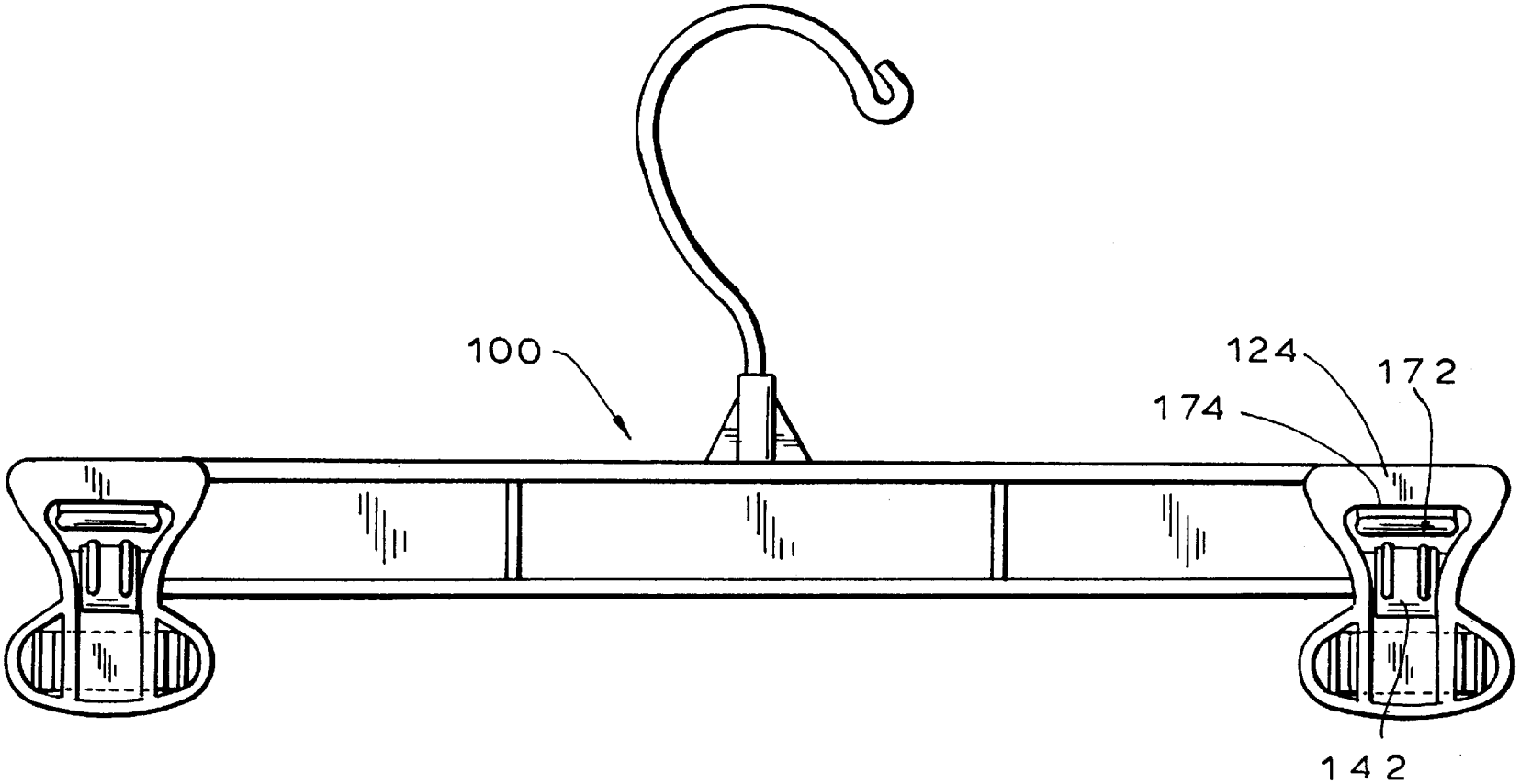
FIG. 9 is a front elevational view of a fourth embodiment thereof.

In the embodiment 10 illustrated in FIGS. 1–6, the recess 50 is defined by projections 50*a* only on the lateral sides of the head 54, and in the embodiment 10" illustrated in FIG. 8, the recess 50" is defined by a projection 50*b* only above the head 54. In the embodiment 10' illustrated in FIG. 7, the head 54 at the upper end 26 of one component 24 fits totally within a recess 50' defined by the side and top projections 50*a,* 50*b* of the other component 22. In this manner the upper end 26 of component 22 provides protection to the top and both sides of the upper end 26 of the other component 24 against accidental relative movement thereof.

The function of the recess 50, 50', 50" is simply to provide protection to the head 54 against pressures exerted thereon in a direction primarily transverse to the hanger 10. In the first embodiment 10 illustrated in FIG. 1, the recess 50 is defined by two raised portions or projections 50*a,* one on either side of the head 54, which protect the head by acting as a partial collar or pocket when the head 54 is received therein. In the second embodiment 10' illustrated in FIG. 7, a raised portion or projection 50*b* also extends horizontally, either spaced above the other raised portions or projections 50*a* (as shown) or connecting the same, so that the head 54 is essentially totally received within the recess 50'. As illustrated, the sides and top of the head 54 fit totally within the sides and top of the recess 50' formed by the three raised portions or projections 50*a,* 50*b*. In the embodiment 10" illustrated in FIG. 8, the recess 50" is defined by only a horizontal raised portion or projection 50*b*.

The recess in the upper end 26 of stationary component 22 may be formed in a variety of different ways. The upper end 26 may be molded so that its raised portion(s) or projections (s) follow the contour of the head 54 at the upper end 26 of the pivotable component 24, thereby to form sidewalls 50*a,* a top 50*b,* or a top and sidewalls 50*a,* 50*b* for receipt of the head 54. Alternatively, the recess may be defined simply by one or more projections (not shown) extending forwardly from the upper end 26 of stationary component 22 and defining a functional recess for receiving the full thickness of the head 54 of component 24, regardless of whether the components are in the releasing or gripping orientations. In any case a user's finger, rearwardly pressed on the forward surface of the head 54, is capable of moving the head 54 from the abutting or gripping orientation to the releasing orientation (that is, from FIG. 2A or 2B to FIG. 2C).

The recess of the upper end 26 of stationary component 22 should be deep enough to receive the head 54 of the upper end 15 of the pivotable component 24 such that the recess may shield and shelter the received head 54 from pressures exerted by closely adjacent hangers or articles thereon, when the clip is in the gripping orientation and the bottom ends 30 of the components 22, 24 are maintaining an article, such as a garment G, therebetween as shown in phantom line in FIG. 2B. Further, the recess of the upper end 26 of stationary component 22 should be deep enough to receive the head 54 at the upper end 26 of the pivotable component 24 such that the user may intentionally move the upper ends 26 closer together to obtain the releasing orientation wherein the bottom ends 30 of the components 22, 24 enable passage of an article or garment therebetween—e.g., by rearward pressure of a finger disposed on the head 54 intermediate the recess side surfaces 52.

Thus, the recess 50 should be sufficiently deep to extend forwardly further than the head by a distance sufficient to provide protection to the head against accidental relative movement thereof from a gripping orientation (FIG. 2B) towards a releasing orientation (FIG. 2C) while still enabling intentional relative movement of the head and the recess from the gripping orientation (FIG. 2B) towards the releasing orientation (FIG. 2C). In use, the pinch-grip of the hanger of the present invention is protected against accidental opening due to the pressures exerted by adjacent hangers or articles during display, handling and transport, the hanger is especially well suited for use in the transport of clothing. On the other hand, the pinch-grip may be easily opened by intentionally pressing together the upper ends of the two components.

It is not necessary for the recess 50 to be sufficiently deep to extend forwardly further than the head 54 by a distance sufficient to protect the head and the recess against accidental relative movement thereof from an abutting orientation (see FIG. 2A) in which the lower ends 30 of the two components 22, 24 abut (that is, there is no article suspended therebetween) to either the gripping or releasing orientation (see FIGS. 2B and 2C). In this abutting orientation, there is no suspended article to be accidentally released from the hanger if the upper ends 26 of the two components 22, 24 are accidentally pressed together, for example, by adjacent articles or hangers. Indeed, it is preferred (but not necessary) that the upper end 26 of the pivotal component 24 extend slightly forwardly of the recess 50 when the components 22, 24 are in the abutting orientation, as illustrated in FIG. 2A, thereby to facilitate grasping of the pivotal component 24 by a user about to suspend an article from the pinch-grip 20. However, alternatively, the upper end 26 of the pivotal component 24 may not extend as far forwardly as the recess 50 when the components are in the abutting orientation, as illustrated in FIG. 2D.

Optionally the bottom ends 30 of the components 22, 24 may be provided with special gripping pads 60 in order that the bottom ends 30 may more securely grasp therebetween an article, such as a garment G (see FIG. 2B), when the components 22, 24 are in the gripping orientation. The illustrated gripping pads 60 are preferably formed separately from the components 22, 24 and inserted thereinto by means of barb-like securing means 60A which are received within the component bottom ends 30 (see FIGS. 2A, 2B, and 2C).

In the illustrated preferred embodiment, there is a pivot means or axle 40 on each side of the central potion 32 of the movable component 24. These pivot means 40 are received in pivot seats 62 in the central portion 32 of the stationary component 22 (the pivot seat 62 being best illustrated in FIG. 6). However, as well be recognized by those skilled in the art, a variety of conventional means may be used instead to pivotably secure together the central portions 32 of the components 22, 24, preferably adjacent the upper portions 26.

In the illustrated preferred embodiment, an inverted "U"-shaped spring 42 includes a pair of extended spring legs 42A which are received in the recesses or grooves 68 of each component 22, 24 (the recesses or grooves 68 being best illustrated in FIG. 6). Each recess or groove 68 of a component 22, 24 preferably terminates at its bottom end adjacent the top of the gripping pad 60 and at its top end adjacent a ramp 66 which projects towards the other component 24, 22. The ramps 66 bear on the spring 42 adjacent its bight to keep the bottom ends of the spring legs 42A in close proximity to the component bottom ends 30. The recess or groove 68 of each component 22, 24 may be turned inwardly to define a beveled or partially covered recess or groove 68 into which a spring leg 42A may enter from above and which then locks the spring leg 42A thereto for movement horizontally as a unit. Alternatively, each spring leg 42A may extend down the recess or groove 68 and then outwardly to the outer surface of the component 22, 24 and then downwardly again along the connecting component portion 32 and possibly the lower end 30. Generally, the same effect is obtained in both instances as the action of the spring 42 is to bias the pinch-grip 20 to the closed or gripping and abutting orientations. The spring 42 biases the components 22, 24 to the closed or gripping orientation, thereby to enable gripping of an article portion by the gripping pads 60, or to the abutting orientation if no article portion is disposed between the gripping pads 60. On the other hand, when the head 54 is manually forced deeper into recess 50, against the influence of the spring 42, the component bottom ends 30 (and the bottom ends of the spring legs 42A) separate further and the components 22, 24 move to the open or releasing orientation, thereby to enable passage of an article portion between the gripping pads 60. It will be appreciated by those skilled in the art that other biasing mechanisms may be used as the biasing means 42 and that various different structures of the components 22, 24 may interact therewith.

While the recess 50 (typically on the stationary component 22) and head 54 (typically on the pivotable component 24) provide a high level of protection against accidental opening of the pinch-grips, a simpler construction may frequently be used to obtain the same desirable results. Thus, referring now to FIGS. 9–15, therein illustrated is a fourth embodiment of a secure pinch-grip hanger according to the present invention, generally designated 100. Components of hanger 100 similar in function to the components of hanger 10 are indicated by corresponding numbers in the 100 series.

Figure 11:
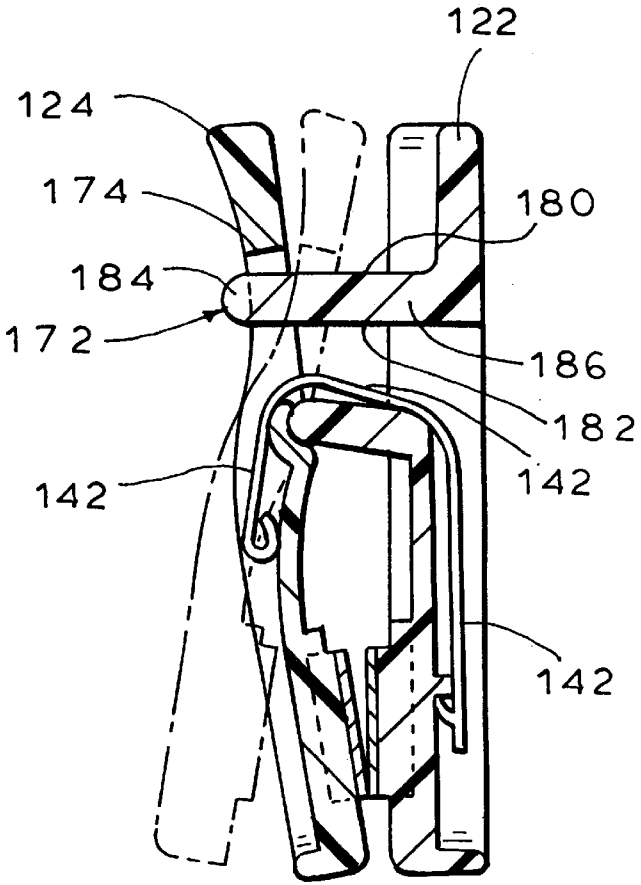
FIG. 11 is a sectional view taken along the line 11—11 of FIG. 10, with the pinch grip being shown in the abutting orientation in solid line and in the releasing orientation in phantom line.
Figure 10:
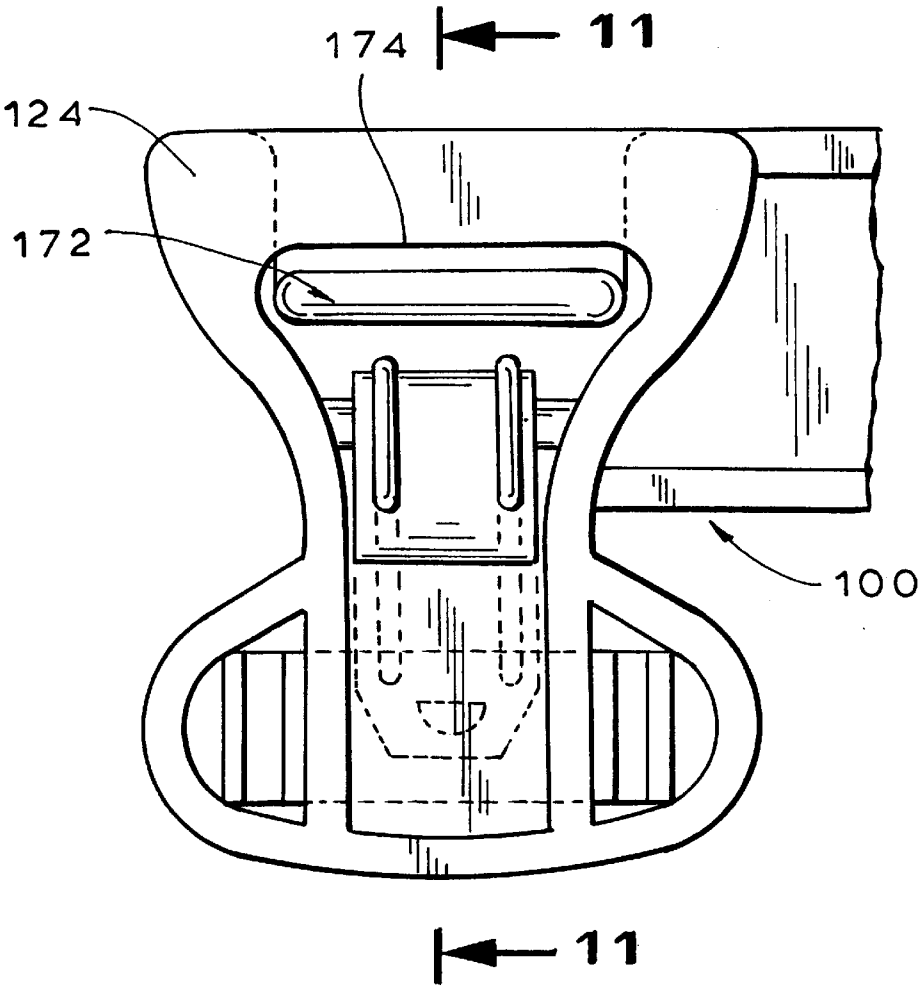
FIG. 10 is a front elevational view, to an enlarged scale, of the pinch grip thereof.
Figure 13:
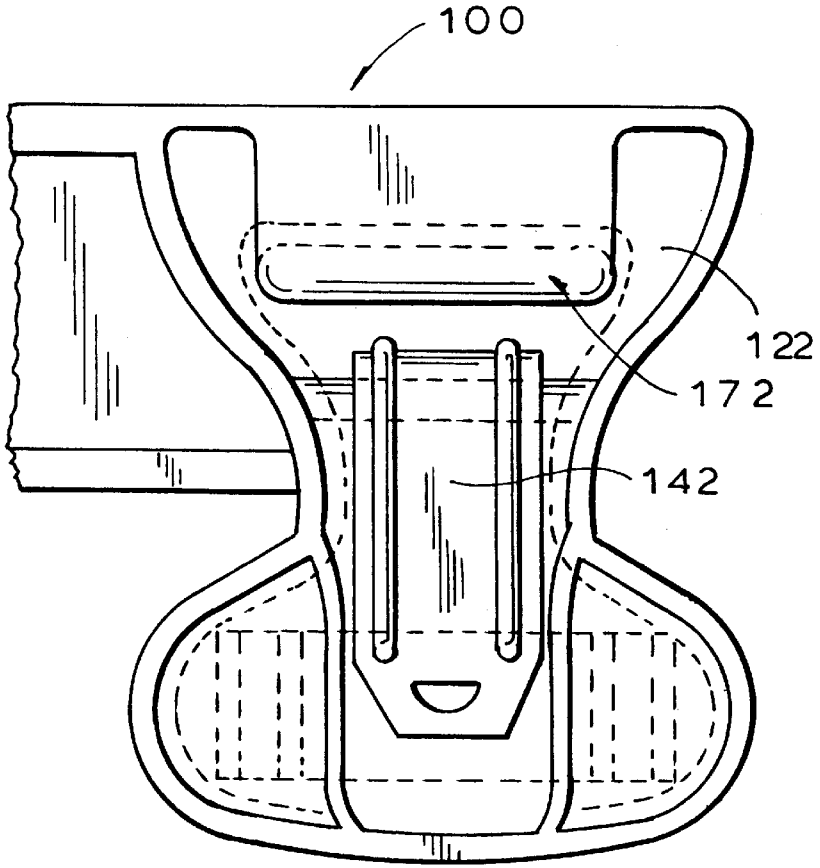
FIG. 13 is a fragmentary elevational view of the pinch grip.
Figure 12:
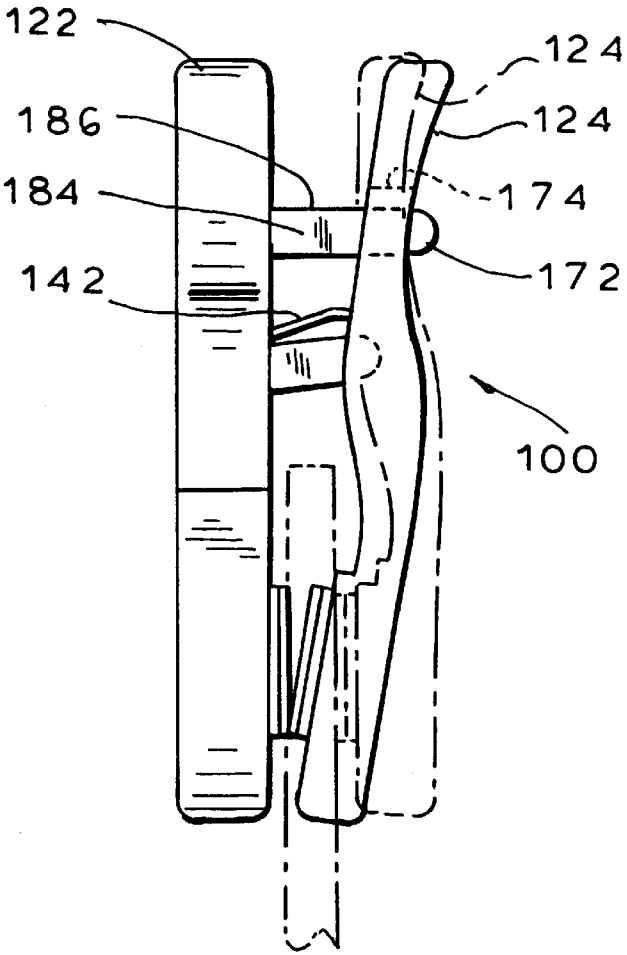
FIG. 12 is a side elevational view thereof with the pinch grip being shown in the abutting orientation in solid line and in the gripping orientation (with the lower ends separated by an article) in phantom line.

Instead of the aforementioned recess 50 and head 54 arrangement in the embodiment 10 described above, a stationary one 122 of the pair of upper ends is configured and dimensioned to define a projection, generally designated 172, extending generally forwardly through the pivotable one 124 of the pair of upper ends. The pivotable one 124 of the pair of upper ends defines an aperture 174 therethrough. Referring now to FIGS. 11 and 12 in particular, the projection 172 is configured and dimensioned to extend forwardly (that is, towards and through the aperture 174 of the pivotable upper end 124) further than the pivotable upper end 124 by a distance sufficient to protect the pivotable upper end 124 against some accidental relative movement thereof from a gripping orientation towards a releasing orientation, while still enabling intentional relative movement of the pivotable upper end 124 from the gripping orientation to the releasing orientation.

To this end, the projection 172 has a top wall 180, a bottom wall 182, and a laterally spaced apart pair of side walls 184 connecting the top and bottom walls 180, 182. The shaft 186 of the projection 172 intermediate the ends thereof is smaller in cross section than the aperture 174 such that it does not interfere with the pivotable movement of the pivotable upper end 124 over its normal range of motion. The aperture 174 extends fully about a cross section of the shaft 186 of projection 172 at all times, and preferably fits loosely about the shaft 186 of projection 172 so as to accommodate movement of the shaft 186 of projection 172 within the aperture 174 as the upper ends 122, 124 are intentionally moved between the abutting or gripping orientations and the releasing orientation.

The extension of the projection 172 horizontally forwardly beyond the pivotable upper end 124 protects the pivotable upper end 124 from being accidentally displaced rearwardly (toward the stationary upper end 122), but allows intentional movement of the pivotable upper end 124 rearwardly (toward the stationary upper end 122) when the two upper ends 122, 124 are grasped above the level of the projection 172 and squeezed together.

The projection 172 may be formed of the same plastic as the reminder of the hanger (or at least the pivotable upper ends thereof) with appropriate ribbing and structure being provide to insure that a horizontal rearward force exerted on the free end of the projection 172 does not seriously diminish its length or unduly bend the same. The projection 172 is preferably resiliently bendable so that a minor vertical displacement of the projection 172 under the influence of the aperture 174 and the aforementioned clasping force is possible. Alternatively, the rigid projection 172 (and optimally the shaft 186 thereof) is slightly curved so as to provide a radius of curvature generally similar to the radius of curvature of the path of motion of the aperture 174.

Preferably the free end of projection 172 is enlarged relative to the shaft thereof after the free end has been passed through the aperture 174, thereby to preclude accidental removal of the entire projection 172 from the aperture 174.

Again, it is not necessary that the free end of projection 172 extend forwardly from the stationary upper end 122 beyond the pivotable upper end 124 further than is required to maintain the components against some accidental relative movement from a gripping orientation towards a releasing orientation. For example, the projection 172 need not prevent accidental relative movement of the pivotable upper end 124 relative to the stationary upper end 122 when the lower ends 130 of the components are in abutting orientation (that is, without any article being disposed therebetween) since there is then no suspended article to be accidentally released.

While the projection 172 has been described hereinabove as being a part of the stationary upper end 122, clearly it could alternatively be a part of the pivotable upper end 124 and extend through an aperture in the stationary upper end 122. Indeed, the projection 172 may be formed as part of the spring 142 and extend through an aperture in either the pivotable or stationary upper end.

It will be appreciated that the projections 50*a*, 50*b* and 172 all perform the same function of preventing some accidental relative movement of the pinch-grip components from the gripping orientation towards the releasing orientation. In the gripping orientation, projections 50*a* and 50*b* of one (preferably stationary) component extend at least partially about the head of the other (preferably pivotable) component, while projection 172 of one (preferably stationary) component extends through an aperture in the head of the other (preferably pivotable) component.

To summarize, the present invention provides a secure pinch-grip hanger, suitable for suspending articles during transport, display and handling, the hanger being simple to manufacture, use and maintain and comparable in cost to a conventional hanger of the same type.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A hanger comprising:

(A) an attachment portion for securing said hanger to a support; and (B) at least one pinch-grip for receiving an article for hanging, said pinch-grip including:

(i) a pair of first and second components cooperatively defining a pivot axis, each of said components including an upper end extending above the pivot axis and a lower end extending below the pivot axis, said upper end of said first component defining two lateral sides and a top connecting said lateral sides of said first component, and said upper end of said second component defining a horizontally spaced pair of projections extending towards said two lateral sides of said upper end of said first component and adjacent said two lateral sides thereof, said pair of projections defining therebetween a horizontally extending opening disposed at the top of said first component; and (ii) means for biasing said lower ends together to hold an article therebetween and for permitting separation of said lower ends to an open position by pivotal movement of at least one of said components relative to the other of said components about said pivot axis;

said projections inhibiting some accidental movement of the pinch-grip towards the open position while permitting intentional movement of the pinch-grip towards the open position.

2. The hanger of claim 1 wherein at least one of said horizontally-spaced pair of projections does not extend beyond said one component when said lower ends of said components are abutting without any article therebetween.

3. The hanger of claim 1 wherein at least one of said horizontally-spaced pair of projections extends beyond said one component when said lower ends of said components are abutting without any article therebetween.

4. The hanger of claim 1 wherein at least one of said horizontally-spaced pair of projections extends below at least a portion of said one component when said lower ends of said components are abutting without any article therebetween.

5. The hanger of claim 1 wherein said biasing means includes means for securing said components together.

6. The hanger of claim 1 wherein said projections extend from the other of said components.

7. A hanger comprising:

(A) an attachment portion for securing said hanger to a support; and (B) at least one pinch-grip for receiving an article for hanging, said pinch-grip including:

(i) a movable first component and a stationary second component cooperatively defining a pivot axis, each of said components defining an upper end extending above the pivot axis and a lower end extending below the pivot axis, said upper end of said first component defining two lateral sides and a top connecting said lateral sides of said first component, and said upper end of said second component defining a horizontally spaced pair of projections extending towards and along said two lateral sides of said upper end of said first component and adjacent said two lateral sides thereof, said pair of projections defining therebetween a horizontally extending opening disposed at the top of said first component;

(ii) means for biasing said lower ends together and for permitting separation of said lower ends to an open position by pivotal movement of said upper end of said first component relative to the other of said components about said pivot axis;

said projections inhibiting some accidental movement of said upper end of said first component towards the open position while permitting intentional movement of said upper end of said first component towards the open position.

8. The hanger of claim 7 wherein at least one of said horizontally-spaced pair of projections does not extend beyond said upper end of said first component when said lower ends of said components are abutting without any article therebetween.

9. The hanger of claim 7 wherein at least one of said horizontally-spaced pair of projections extends beyond said upper end of said first component when said lower ends of said components are abutting without any article therebetween.

10. The hanger of claim 7 wherein at least one of said horizontally-spaced pair of projections extends below at least a portion of said upper end of said first component when said lower ends of said components are abutting without any article therebetween.

11. The hanger of claim 7 wherein said biasing means includes means for securing said first and second components together.

12. The hanger of claim 7 wherein said projections extend from said upper end of said second component.

13. The hanger of claim 12 wherein a third projection extends from said upper end of said second component.

14. A hanger comprising:

(A) an attachment portion for securing said hanger to a support; and (B) at least one pinch-grip for receiving an article for hanging, said pinch-grip including:

(i) a pivotable first vertically-extending component and a stationary second vertically-extending component cooperatively defining a pivot axis, each said component defining an upper end extending above the pivot axis and a lower end extending below the pivot axis, said upper end of said first component defining two lateral sides and a top connecting said lateral sides of said first component, and said upper end of said second component defining a horizontally spaced pair of projections extending towards and along the length of said two lateral sides of said upper end of said first component and adjacent said two lateral sides thereof, said pair of projections defining therebetween a horizontally extending opening disposed at the top of said first component;

(ii) means for permitting pivotal movement of said first component; and (iii) means for biasing said lower ends together and for permitting separation of said lower ends to an open position by pivotal movement of said upper end of said first component;

a first projection of said pair of projections located adjacent to one of said sides of said upper end of said first component and a second projection of said pair of projections located adjacent to the other one of said sides of said upper end of said first component, said projections inhibiting some accidental movement of said upper end of said first component towards the open position while permitting intentional movement of said upper end of said first component towards the open position.

15. The hanger of claim 14 wherein said projections extend from said upper end of said second component.

16. A hanger comprising:

(A) an attachment portion for securing said hanger to a support; and (B) at least one pinch-grip for receiving an article for hanging, said pinch-grip including:

(i) a pair of vertically-extending components, each said component defining an upper end and a lower end;

(ii) means for pivotally securing said components together; and (iii) means for biasing said lower ends together and for permitting separation of said lower ends to an open position by movement of at least one of said upper ends;

one of said upper ends including a projection extending through the other of said upper ends, and said other upper end defining an aperture for passage of said projection therethrough such that said projection inhibits some accidental movement of said other upper end towards the open position while still enabling intentional movement of said other upper end towards said open position.

17. The hanger of claim 16 wherein said projection has a top wall, a bottom wall and a pair of sidewalls connecting said top and bottom walls, said projection being smaller in cross-section than said aperture.

18. The hanger of claim 16 wherein said aperture extends fully about said projection at all times.

19. The hanger of claim 16 wherein said one upper end is stationary, and said other upper end is pivotable relative to said stationary one upper end.

20. The hanger of claim 16 wherein said securing means and said biasing means are the same.

21. A hanger comprising:

(A) an attachment portion for securing said hanger to a support; and (B) at least one pinch-grip for receiving an article for hanging, said pinch-grip including:

(i) a pair of first and second components cooperatively defining a pivot axis, each of said components including a lower end extending below the pivot axis for cooperatively receiving the article therebetween and an upper end extending above the pivot axis, said upper end of said first component defining two lateral sides and a top connecting said lateral sides of said first component, and said upper end of said second component defining a horizontally spaced pair of projections extending towards said two lateral sides and top of said upper end of said first component and adjacent said two lateral sides thereof, said pair of projections defining therebetween a horizontally extending opening disposed at the top of said first component; and (ii) means for biasing said lower ends together and said upper ends apart and for permitting separation of said lower ends to a fully extended open position by pivotal movement of at least one of said upper ends relative to the other of said upper ends about said pivot axis;

said projections inhibiting some accidental movement of the pinch-grip towards the open position while permitting intentional movement of the pinch-grip towards the open position.

22. The hanger of claim 21 wherein said pair of components are secured to each other.

23. The hanger of claim 22 wherein said biasing means secures said components to each other.

24. The hanger of claim 21 wherein said pair of components are pivotably secured to each other.

25. The hanger of claim 24 wherein said biasing means pivotally secures said components to each other.

26. The hanger of claim 25 wherein said biasing means includes means for pivotably securing said components together.

27. The hanger of claim 21 wherein said projections extend from said upper end of the other of said pair of components.

28. A hanger comprising:

(A) an attachment portion for securing said hanger to a support; and (B) at least one pinch-grip for receiving an article for hanging, said pinch-grip including:

(i) a first component and a second component cooperatively defining a pivot axis, each of said components including an upper end extending above the Divot axis and a lower end extending below the pivot axis, said upper end of said first component defining two lateral sides and a top connecting said lateral sides of said first component, and said upper end of said second component defining a horizontally spaced pair of projections extending towards and along substantially the entire length of said two lateral sides of said upper end of said first component and adjacent said two lateral sides thereof, said pair of projections defining therebetween a horizontally extending opening disposed at the top of said first component; and (ii) means for biasing said lower ends together to hold an article therebetween and for permitting separation of said lower ends to an open position by pivotal movement of the first component relative to the other of said components about said first pivot axis;

said projections extending towards said first component to inhibit some accidental movement of the pinch-grip towards the open position while permitting intentional movement of the pinch-grip towards the open position.

29. The hanger of claim 28 wherein said pair of projections are horizontally-spaced about said first component.

30. The hanger of claim 28 wherein one of said pair of projections is located adjacent one lateral side of said first component and the other of said projections is located adjacent the other lateral side of said first component.

31. The hanger of claim 28 wherein said projections extend from said second component.

* * * * *